US008034202B1

(12) United States Patent
Hawkins et al.

(10) Patent No.: US 8,034,202 B1
(45) **Date of Patent: *Oct. 11, 2011**

(54) HYPERGOLIC FUELS

(75) Inventors: Tommy W. Hawkins, Lancaster, CA (US); Stefan Schneider, Palmdale, CA (US); Gregory W. Drake, Madison, AL (US); Ghanshyam Vaghjiani, Palmdale, CA (US); Steven Chambreau, Boron, CA (US)

(73) Assignee: The United States of America as represented by the Secretary of the Air Force, Washington, DC (US)

( * ) Notice: Subject to any disclaimer, the term of this patent is extended or adjusted under 35 U.S.C. 154(b) by 507 days.

This patent is subject to a terminal disclaimer.

(21) Appl. No.: 11/973,978

(22) Filed: Oct. 4, 2007

(51) Int. Cl.

| | |
|---|---|
| ***C06B 47/00*** | (2006.01) |
| ***C06B 47/08*** | (2006.01) |
| ***C06B 47/04*** | (2006.01) |
| ***C06B 25/00*** | (2006.01) |
| ***D03D 23/00*** | (2006.01) |
| ***D03D 43/00*** | (2006.01) |

(52) U.S. Cl. ..... 149/36; 149/1; 149/74; 149/88; 149/109.2; 149/109.4

(58) Field of Classification Search ..... 149/36, 149/1, 74, 88, 109.2, 109.4
See application file for complete search history.

(56) References Cited

U.S. PATENT DOCUMENTS

| | | | | |
|---|---|---|---|---|
| 3,405,175 | A * | 10/1968 | Carvalho et al. | 564/106 |
| 2004/0014925 | A1 * | 1/2004 | Hell et al. | 528/31 |
| 2005/0269001 | A1 * | 12/2005 | Liotta et al. | 149/1 |

* cited by examiner

*Primary Examiner* — James McDonough
(74) *Attorney, Agent, or Firm* — AFMCLO/JAZ; Bart S Hersko

(57) ABSTRACT

Provided is a hypergolic bipropellant formed by combining a IL fuel having a dicyanamide anion and a nitrogen-containing, heterocyclic-based cation with an oxidizer for such fuel.

6 Claims, No Drawings

HYPERGOLIC FUELS

STATEMENT OF GOVERNMENT INTEREST

The invention described herein may be manufactured and used by or for the Government for governmental purposes without the payment of any royalty thereon.

CROSS-REFERENCE TO RELATED PATENT APPLICATIONS

This Application Relates to patent application Ser. No. 10/816,032 entitled "Hypergolic Bipropellants" by Hawkins et al., filed on 2 Apr. 2004.

FIELD OF THE INVENTION

This invention relates to bipropellants, particularly hypergolic bipropellants.

BACKGROUND OF THE INVENTION

A conventional, storable bipropulsion system uses a hydrazine (e.g., monomethylhydrazine) as the fuel component. This fuel affords useful performance characteristics and has a fast ignition with the oxidizer. This fast (hypergolic) ignition provides system reliability for on-demand action of the propulsion system. The conventional, storable bipropulsion system is limited by its inherent energy density that can be traced, in large measure, to the density of the fuel. Also, there are significant costs and operational constraints associated with handling the fuel that derives from the fuel's very toxic vapor.

The challenge is made more difficult since the fuel/oxidizer combination is desired to be hypergolic. Hypergolicity is defined as self ignition that occurs within milliseconds after contact of fuel with oxidizer, herein "fast ignition". Hypergolic ignition is valuable because it offers high reliability, eliminates the inert mass of a separate ignition system, and provides an ability to restart for missions that require multipulse operation.

Accordingly, there is need and market for hypergolic bipropellants that overcome the above prior art shortcomings.

There has now been developed ionic hypergolic bipropellant fuels of reduced toxicity, as also described below.

SUMMARY OF THE INVENTION

Broadly the present invention provides a hypergolic bipropellant that has a salt or IL fuel, containing at least one dicyanamide anion and at least one heterocyclic based cation and b) an oxidizer for same. Preferred are oxidizer/fuel ratios ranging from 1:1 to 7:1 (wt/wt).

DESCRIPTION OF PREFERRED EMBODIMENTS

Referring to the present invention in detail advanced bipropellant fuels with fast ignition, upon mixing with storable oxidizer, have been synthesized and demonstrated.

The bipropellant fuels are based upon salts containing the dicyanamide anion (FIG. 1). The salts employ nitrogen-containing, heterocyclic-based cations such as the imidazolium cation (FIG. 2).

Figure 1

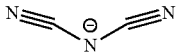

Figure 2

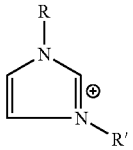

Reactivity of a range of substituted imidazolium dicyanamides with red fuming nitric acid was performed. Representative experimental results are shown in Table 1. Fast ignition (i.e., ignition occurring on the order of $10^2$ millisecond or lower) is observed with these dicyanamide-based ionic liquid (IL) fuels upon contact with the liquid oxidizer.

TABLE 1

Ignition Response of Ionic Liquid Fuels With Red Fuming Nitric Acid

| Compound | Fast Ignition* |
|---|---|
| 1-propargyl-3-methyl-imidazolium dicyanamide | Yes |
| allyl-3-methyl-imidazolium dicyanamide | Yes |
| 1-(3-butenyl)-3-methyl-imidazolium dicyanamide | Yes |

*Order of $10^2$ millisecond or less

The critical role of the dicyanamide anion in effecting the chemistry necessary for fast ignition can be observed in the data from Table 2. The table displays ignition test results with two ionic liquid fuels that contain the same cation, but have different anions. While salt molecules contain highly energetic (i.e., positive formation enthalpy), high-nitrogen anions, the dicyanamide-based molecule solely displays fast ignition.

TABLE 2

Ignition Response Of Ionic Liquid Azide Compared To Dicyanamide With Red Fuming Nitric Acid

| Compound | Fast Ignition* |
|---|---|
| allyl-3-methyl-imidazolium azide | No |
| allyl-3-methyl-imidazolium dicyanamide | Yes |

*Order of $10^2$ millisecond or less

With employment of a dicyanamide anion, a range of heterocyclic-based ionic liquids (ILs) are available as high energy density fuels for bipropulsion applications. These ILs may incorporate, not only the substituted imidazolium cation, but can employ the substituted 1,2,4-triazolium, substituted 1,2,3-triazolium, substituted pyrollidinium, substituted pyridinium and substituted tetrazolium cations. FIG. 3 shows such representative structures.

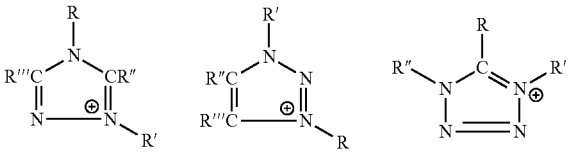

-continued

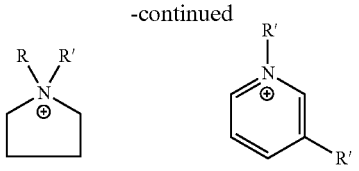

where R', R" and R'" are selected from saturated and unsaturated hydrocarbon chains, strained ring and high-nitrogen (such as azido-, cyano-, amino-, guanidyl- and hydrazino) substituents.

FIG. 3. Substituted 1,2,4-triazolium, 1,2,3-triazolium, pyrrolidinium, pyridinium, and tetrazolium cations, respectively In the preferred embodiment of the invention, the substituents to the heterocyclic ring of the cation confer low melting points and low viscosity, while also incorporating structures that increase heat of combustion of the fuel with the storable liquid oxidizer. Such substituent (i.e., R-group) structures may be saturated (alkyl), unsaturated (e.g., alkenyl- or alkynyl-), strained-ring (e.g., cyclopropyl-), or high-nitrogen moieties (e.g., azido-, cyano-, amino-, or hydrazino-).

Further aspects of the invention are discussed in a Paper entitled *Ionic Liquid Hypergols* by T. Hawkins et al, soon to be submitted to Angewandte Chemie of Germany for publication which Paper is incorporated herein by reference. In the Paper is discussed the preparation of certain dicyanamides as illustrated in the following example:

Example 1

The starting materials, 1-R-3-methylimidazolium bromides (1-5 below), were prepared by alkylation of methylimidazole followed by metathesis with freshly prepared silver dicyanamide (Scheme 1).

Scheme 1. Synthesis of 1-R-3-methylimidazolium dicyanamides

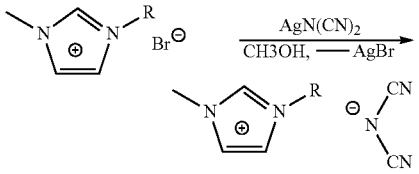

R = -allyt(1),[11]-(3-butenyl)(2), -propargyl(3), -(2-butynyl)(4), -(2-pentynyl)(5)

General procedure for preparation of salts (1-5 and 6). To a 100 mL Schlenk flask equipped with a Teflon stir bar and purged with nitrogen the 1-R-3-methyl-imidazolium bromides (or 1-methyl-4-amino-1,2,4-triazolium iodide) were added and dissolved in ca. 30 mL of methanol. In the dark a ca. 5% excess of freshly prepared silver dicyanamide was added to the stirred solution. Stirring was continued over night. The insoluble silver halide and excess silver dicyanamide were removed by filtration. The solvent was removed under reduced pressure yielding the desired ionic liquid dicyanamides.

1-allyl-3-methyl-imidazolium dicyanamide (1). 14.0 g (69.3 mmol) 1-allyl-3-methyl-imidazolium bromide was used for the metathesis. Yield 94%; red liquid;

1-(3-butenyl)-3-methyl-imidazolium dicyanamide (2). 1.8 g (8.3 mmol) 1-(3-butenyl)-3-methyl-imidazolium bromide was used for the metathesis. Yield 93%; amber liquid;

1-propargyl-3-methyl-imidazolium dicyanamide (3). 5.8 g (28.8 mmol) 1-(3-butenyl)-3-methyl-imidazolium bromide was used for the metathesis. Yield 86%; dark red liquid 1-(2-butynyl)-3-methyl-imidazolium dicyanamide (4). 1.1 g (5.3 mmol) 1-(2-butynyl)-3-methyl-imidazolium bromide was used for the metathesis. Yield 97%; amber solid;

1-(2-pentynyl)-3-methyl-imidazolium dicyanamide (5). 1.3 g (5.7 mmol) 1-(2-pentynyl)-3-methyl-imidazolium bromide was used for the metathesis. Yield 79% (after recrystallization from methanol solution layered with diethyl ether); dark brown solid;

1-methyl-4-amino-1,2,4-triazolium dicyanamide (6). 0.7 g (3.3 mmol) 1-methyl-4-amino-1,2,4-triazolium iodide was used for the metathesis. Yield 89%; colorless liquid.

Further data on the above dicyanamides are provided in the above cited Paper.

The above dicyanamides are then combined with suitable oxidizers per the invention such as RFNA, IRFNA, WFNA, hydrogen peroxide and NTO, to provide the hypergolic bipropellants of the invention. Scheme 2 indicates applicable oxidizer structures to the invention:

Scheme 2. Applicable oxidizers

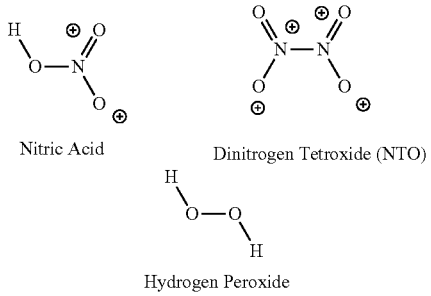

In operation, the bipropellant of the invention is utilized as follows. The IL fuel is stored in a propulsion system fuel tank and the oxidizer is stored in a separate tank. When thrust is desired, the fuel and oxidizer are each sprayed through injector elements into a chamber in a rocket and the fuel and oxidizer then come into contact. Ignition immediately ensues and combustion of the fuel by the oxidizer creates pressurized gases that provide thrust as they exit a propulsion nozzle.

Thus advanced bipropellant fuels with fast ignition upon mixing with storable oxidizer have been synthesized and demonstrated per the invention. The bipropellant fuels are based upon salts containing the dicyanamide anion and employ nitrogen-containing, heterocycle-based cations such as the imidazolium, triazolium or tetrazolium cations.

Fast igniting, ionic liquid fuels provide a means to overcome significant limitations of the state-of-the-art, storable bipropulsion system. Such ionic liquid fuels can provide greater than 40% improvement in density over hydrazine fuels. This confers greater energy density to the bipropulsion system. Also, the negligible vapor pressure of ionic liquid fuel provides a means of significantly reducing costs and operational constraints associated with handling the fuel.

Ignition of propellants often constitutes a major hurdle in propellant development. Therefore, discovering an IL which shows hypergolic ignition with common oxidizers represents a major achievement. Compounds 1-3, above, are, in fact, the first ILs demonstrated to be hypergolic.

A preferred embodiment of the invention is the employment of pure dicyanamide-based ionic liquid as a fast-igniting, bipropellant fuel. However, the use of dicyanamide salt molecules as components in fuel mixtures to confer fast-ignition and density is also a viable mode of the invention.

A hypergolic bipropellant based upon ionic liquid fuel (dicyanamide-based IL) and an oxidizer (RFNA) has potential as a replacement for bipropellant currently used in on-orbit spacecraft propulsion. Other application areas include liquid engines for boost and divert propulsion. The high volumetric impulse that is inherent in the new hypergol lends itself to applications that require high performance from volume limited systems. The low vapor toxicity of the ionic liquid fuel is a benefit over toxic hydrazine fuels currently used.

The performance aspects of this new hypergol can find use in commercial applications in satellite deployment and commercial space launch activities.

What is claimed is:

1. A bipropellant comprising a) an IL fuel containing at least one dicyanamide anion and a nitrogen-containing heterocyclic based cation selected from the group consisting of imidazolium, triazolium, pyrollidinium, pyridinium and tetrazolium; and b) an oxidizer for same so as to render said bipropellant hypergolic.

2. The bipropellant of claim 1 wherein said cation is selected from the group consisting of imidazolium, triazolium, pyrollidinium, and pyridinium.

3. The bipropellant of claim 2 comprising one or more cations selected from the group consisting of

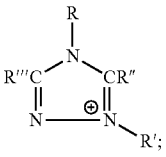

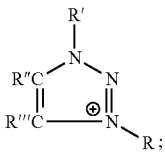

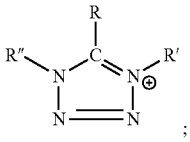

-continued

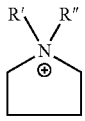

and

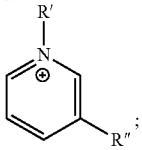

wherein R', R" and R"' are selected from saturated and unsaturated hydrocarbon chains, strained ring and high-nitrogen (such as azido-, cyano-, amino-, guanidyl- or hydrazino) substituents and which cations comprise:

substituted imidazolium (such as 1-propargyl-3-methyl-imidazolium dicyanamide, 1-allyl-3-methyl-imidazolium dicyanamide and 1-(3-butenyl)-3-methyl-imidazolium dicyanamide), substituted triazolium, substituted pyrollidinium, substituted pyridinium and substituted tetrazolium dicyanamides.

4. The bipropellant of claim 1 wherein said oxidizer is a storable oxidizer selected from the group consisting of RFNA (red fuming nitric acid), IRFNA (inhibited red fuming nitric acid) and WFNA (white fuming nitric acid).

5. The bipropellant of claim 4 wherein the dicyanamide anion acts as a trigger group within the IL molecule to induce hypergolicity in said bipropellant.

6. A bipropellant wherein, to one or more of the cations of claim 3 is added at least one dicyanamide anion to define or augment an IL fuel.

* * * * *